United States Patent [19]

Smith

[11] 4,149,457

[45] Apr. 17, 1979

[54] BALING MACHINES

[75] Inventor: Raymond B. Smith, Preston, England

[73] Assignee: Edbro (Holdings) Limited, Lancashire, England

[21] Appl. No.: 850,634

[22] Filed: Nov. 11, 1977

[51] Int. Cl.[2] ..... B30B 15/08

[52] U.S. Cl. ..... 100/98 R; 83/644; 100/DIG. 1; 100/215; 100/218; 100/232; 100/245; 100/256; 100/295

[58] Field of Search ..... 100/39, 98 R, 232, 215, 100/DIG. 1, 257, 218, 256, 295, 245, 179, 50, 52; 83/542, 644

[56] References Cited

U.S. PATENT DOCUMENTS

| | | | |
|---|---|---|---|
| 1,966,378 | 7/1934 | Dinzl | 100/232 |
| 2,552,958 | 5/1951 | Graham | 83/542 |
| 2,561,169 | 7/1951 | Bickelhaupt | 100/256 |
| 2,984,174 | 5/1961 | Jones | 100/DIG. 1 |
| 3,005,403 | 10/1961 | Van Endert | 100/DIG. 1 |
| 3,190,215 | 6/1965 | Howard | 100/257 |
| 3,229,618 | 1/1966 | O'Connor | 100/98 R |
| 3,367,019 | 2/1968 | Williamson | 100/DIG. 1 |
| 3,603,247 | 9/1971 | Price | 100/245 |
| 3,631,795 | 1/1972 | Maxwell | 100/240 |
| 3,866,522 | 2/1975 | Oswalt | 83/644 |

FOREIGN PATENT DOCUMENTS

| | | | |
|---|---|---|---|
| 845438 | 11/1952 | Fed. Rep. of Germany | 100/DIG. 1 |
| 1147195 | 11/1957 | France | 100/240 |
| 671596 | 5/1952 | United Kingdom | 100/232 |

*Primary Examiner*—Billy J. Wilhite

*Attorney, Agent, or Firm*—Charles E. Brown

[57] ABSTRACT

A baler for car bodies using a simultaneous compression and cutting of the car body to produce in a working chamber of the baler a partly compressed bale which is then reduced to final dimensions in the working chamber by further compression stages.

13 Claims, 5 Drawing Figures

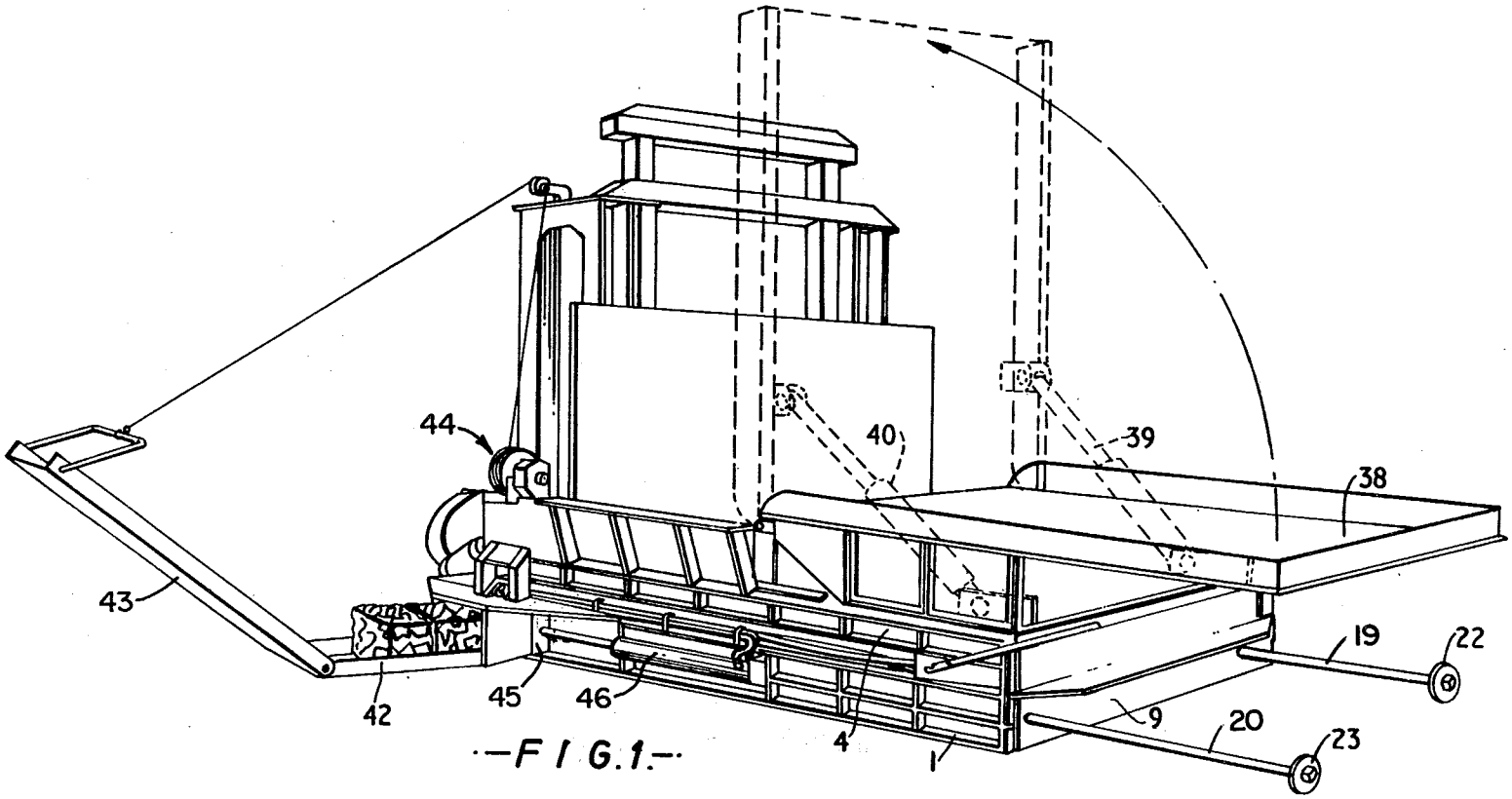
—FIG. 1.—

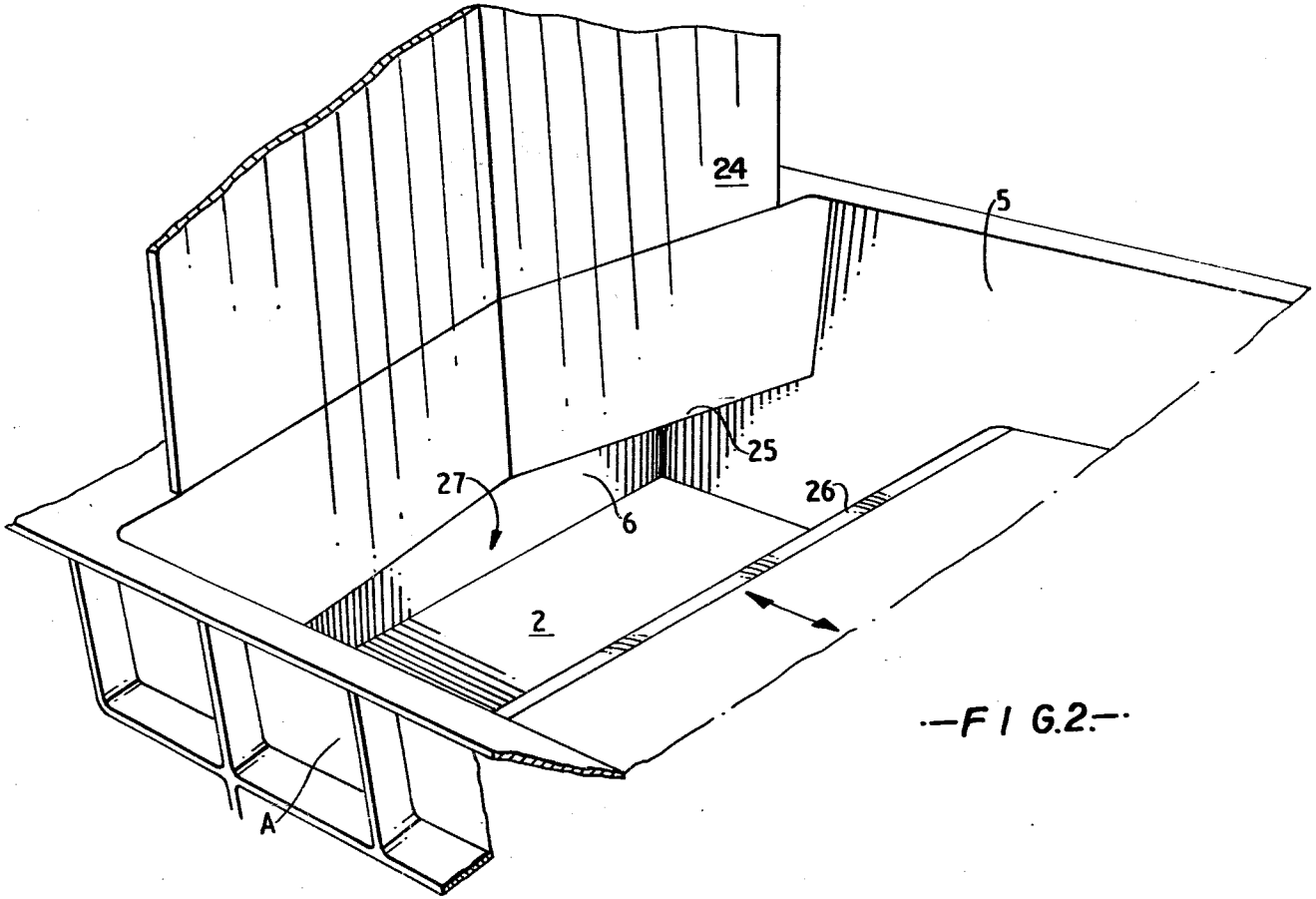
—FIG.2.—

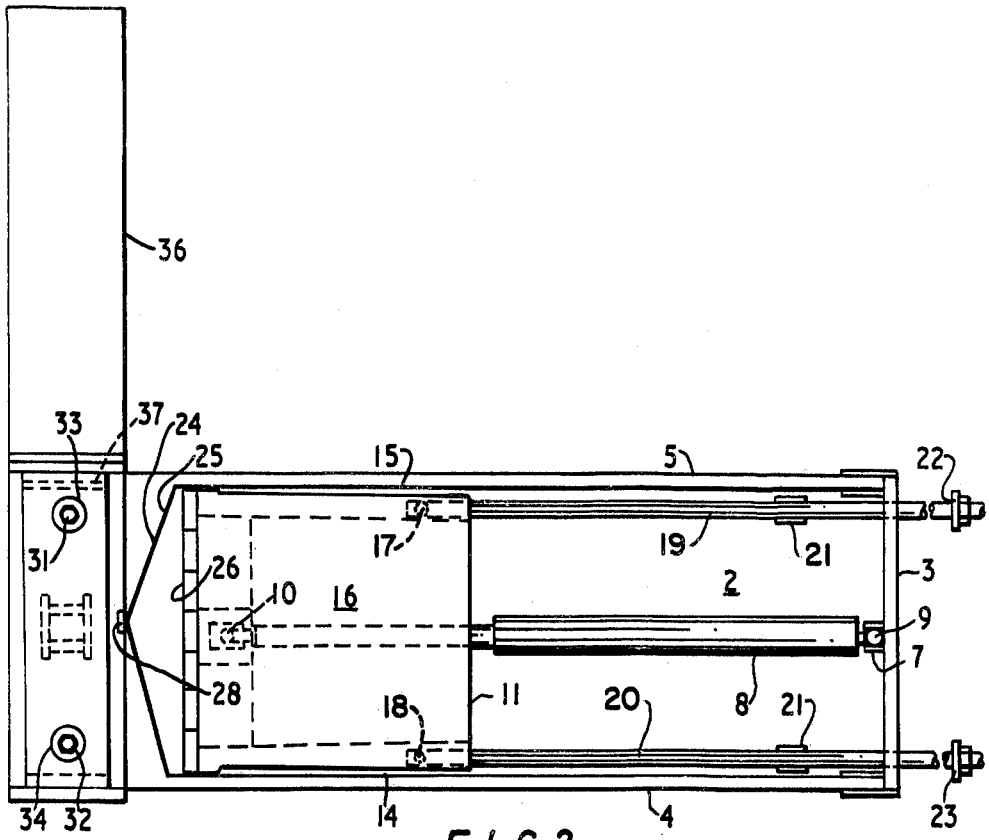
-FIG.3-
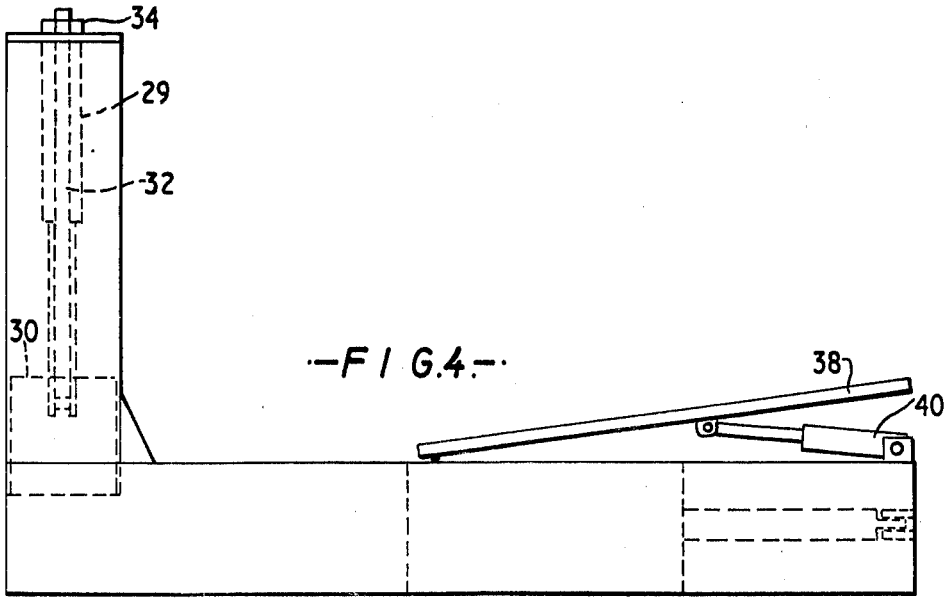
-FIG.4-

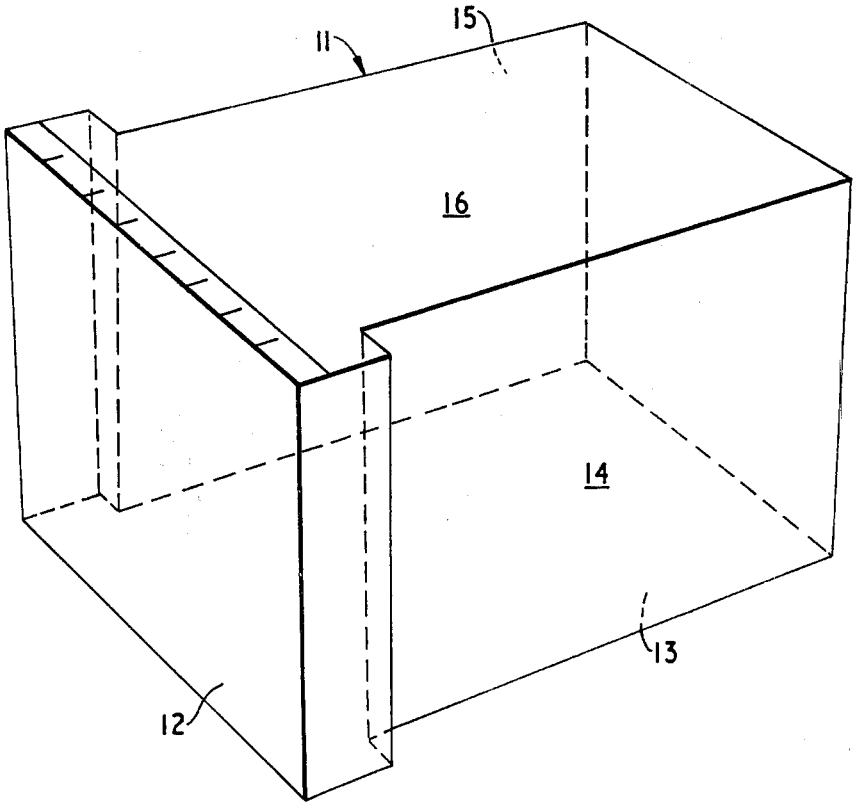
-FIG. 5.-

BALING MACHINES

This invention relates to baling machines, in particular to baling machines for car bodies.

Balers have a working chamber and objects to be baled have firstly to be cut to a size to fit in the chamber. This can involve cutting the object manually prior to insertion in the working chamber and this has the disadvantage that a considerable amount of time and effort is expended.

This problem is particularly acute when one wishes to prepare bundles of steel from car bodies. The steel companies require bundles in twelve inch cubes and thus it is necessary to cut the car body into a large number of portions which are suitable for insertion into baling machines capable of producing twelve inch cube bundles.

According to the present invention there is provided a baling machine for baling portions of a body of metal, the machine comprising a working chamber to receive a portion of the body, cutting means for severing the portion of the body received in the working chamber, from the remainder of the body, and a ram to compress the portion of the body received in the working chamber.

Preferably the articles are gravity fed into the working chamber either by a shute or by a pivotably mounted platform.

Advantageously the rams and platform are hydraulically operable, the arrangement being such that an ejection door opens to eject the compressed bundle when the pressure in the hydraulic fluid reaches a preset maximum value. The ejected bundle is pushed onto an elevated steel channel and as one bundle enters the channel the topmost bundle on the channel falls into a container.

Conveniently the cutting mechanism comprises a pair of steel blades reciprocable relative to each other.

Preferably the extent of compression is controlled by suitably positioned micro switches which are actuated when the rams reach a predetermined position.

Conveniently three hydraulically operable rams at right angles to each other are provided for compressing the bundle, one of which compresses the bundle in a vertical direction.

Advantageously an electromagnetically operable valve is provided for maintaining a preset maximum pressure in the hydraulic fluid transmitted to the rams when they have completed their compression stroke.

The invention will be described further, by way of example, with reference to the accompanying drawings, in which:

FIG. 1 is a perspective view of a baling machine according to the present invention;

FIG. 2 is a perspective view of the blades used for cutting an automobile;

FIG. 3 is a plan view of the machine in FIG. 1 with a part omitted;

FIG. 4 is a side elevation of the machine of FIG. 1; and

FIG. 5 is a perspective view of a part of the machine of FIG. 1.

Referring to the drawings, the baling machine comprises a rigid bed 1 providing a bottom wall 2, a rear wall 3, side walls 4, 5 and a front wall 6. The end wall 3 carries a trunnion bearing 7 pivotally mounting the cylinder end of a hydraulic piston and cylinder unit 8 by a pin 9. The piston end of the unit is pivotally secured, by a pivot pin 10, to a ram 11 sliding on the bottom wall 2. The ram (FIG. 5) is a box-section structure comprising a front wall 12 having a height equal to the depth of waste material to be compressed, and a width which leaves a small clearance at each lateral side of the ram from respective wear plates (not shown) provided on the inner side of walls 4, 5 of the bed 1. The ram comprises a bottom wall 13, side walls 14 and 15, and a top wall 16 shaped so that the sides of the ram leave a larger clearance at the trailing end of the ram between the sides thereof and the respective wear plates. This permits the ram to skew slightly in the bed 1. The ram also has pivoted to it, by pivot pins 17 and 18, two tie rods 19 and 20, which trail rearwardly of the ram and are supported on rollers 21 to pass through respective holes in the rear wall 3 of the bed 1 to extend reawardly therefrom. The extending portions of the tie rods each bear a screw thread receiving a cylindrical stop 22, 23 so that the stop can be displaced axially on the respective tie rod portion by screwing the stop therealong. The tie rods and the piston end of the unit 8 are mounted on the ram with their longitudinal axes lying on a common transverse line, at a position slightly above the tranverse line bisecting the height of the ram to assist in preventing movement of the ram during compression in the vertical plane.

The bed supports an upright plate 24 to which is secured a fixed cutting blade 25, the latter having a "V" section with the apex of the "V" directed towards the front wall 6 of the bed 1, while the ram 11 has a cutting blade 26 formed thereon at the upper forward end of the ram. The space bounded by the front wall 6 of the bed, the front wall 12 of the ram and the respective portions of the lateral and bottom walls of the bed lying therebetween constitutes the working chamber 27 of the machine with the part thereof forward of the apex of the fixed cutting blade 25 defining the volume of the working chambers into which material being baled is compressed by the ram 11.

A limit switch 28, indicated diagrammatically in FIG. 3, is positioned centrally of the width of the bed 1 and the ram carries a striker (not shown) to operate the switch when the ram reaches a predetermined position as will be more fully explained below.

The ram mechanism above described constitutes a first compression stage of the machine; a second compression stage being provided for effecting vertical compression and a third compression stage being provided for effecting a final, lateral, compression of material compressed by the first two stages.

The second compression stage (FIG. 3) comprises a piston and cylinder unit 29, a ram 30, tie rods 31, 32, screws stops 33, 34 and a limit switch forming a ram mechanism in an exactly similar manner to that of the first compression stage; while the third compression stage comprises a piston and cylinder unit 36 bearing at the piston end thereof a ram 37 which when the rams of the first and second compression stages are positioned at the end of their compression strokes, slides in the transverse direction of the machine on the front walls of those rams and on the bottom and front walls of the bed 1 to effect a final compression of the material to be baled. When the pressure in the hydraulic supply reaches a predetermined maximum, the compression stroke of the ram is terminated.

The machine bed also has a platform 38 mounted thereon; the platform being pivoted to the lateral walls of the bed at the retracted position of ram 11 and being operable to swing from a horizontal position to a vertical position about the pivots by a pair of piston and cylinder units 39 and 40 respectively mounted on the lateral walls of the bed 1.

In use of the machine to compress material to be baled, say, a car, the car is deposited on the platform 38 with the latter in its horizontal position. The platform is then pivoted to its vertical position to drop the lower end of the car into the working chamber of the machine. Once the car body is in a vertical position the operator switches the machine to operate automatically. A pump unit delivers hydraulic medium to the first hydraulic ram, and the portion of the car body resting in the working chamber, which in this embodiment is approximately twenty four inches deep, is severed by the blades. At the same time, the first ram compresses the cut portion to within twelve inches of the front wall of the working chamber. In this action, if the moving blade becomes unevenly loaded due to different toughness of the material of the car being compressed, the ram 11 can skew in the bed so as, in effect, to pivot the moving blade around the tougher material towards the fixed blade. By this means, additional leverage is applied to the tougher material, and this enables the moving blade to cut through material that would otherwise require a higher hydraulic pressure and, therefore, machine parts of a thicker section. This, in turn would increase the expense of the machine. Cutting through of the material is also facilitated by the "V" shape of the fixed blade since this ensures that the cutting motion has some degree of slicing action and not merely a crushing action, thus facilitating the cutting of tougher material.

However, should the machine be overloaded, whether due to excessive material or unsuitable material, the hydraulic system is arranged so that once a predetermined maximum pressure is reached, the pressure is maintained for a limited period, e.g. six seconds, and then released and the ram retracted to permit the excessive or the unsuitable material to be removed.

The tie rods pivotally secured to the ram 11 ensure that should the ram become skewed in a compression and cutting operation, the ram 11 will, nevertheless, at the end of its stroke be left square in the bed i.e. with the front wall 12 of the ram aligned on a transverse line of the bed 1 so that the predetermined compressed volume of the material is precisely achieved.

For this purpose, the stops on the tie rods 19 and 20 are used to determine the stroke of the ram. Before a working operation of the machine, they are positioned so that the stops encounter the exterior face of the rear wall 3 of the bed 1 when the front wall of the ram 11 is square in the bed and has been advanced precisely to the final position required by the degree of compression to be effected; the limit switch being set up to correspond to this position. Thus, should one side of ram reach that position before the other side, the switch will not be operated and pressure will be maintained on the ram until the other side of the ram also reaches the final position and both stops on the tie rods 19 and 20 are in contact with rear wall 3 of the bed 1.

In addition to the advantage mentioned above, a further advantage of having the ram mounted so that it can skew in the bed 1 is that the tolerance to be met in forming the bed and the ram are so much easier than they would otherwise be, for instance, the tail end clearance of the ram from the respective wear plates may be one half an inch.

For this reason, the same ram mechanism is used in the vertical compression stage even though in this stage no cutting action takes place.

In the third compression stage it has been found adequate, in accordance with usual practice, merely to use a ram having greater length (the dimension in the direction of the stroke of the ram) than width or height to obtain the precision of movement required.

The second hydraulic ram compresses the material in the working chamber downwards to within twelve inches of the base of the working chamber.

The third hydraulic ram presses the partially compressed material from one side of the machine against a sliding door 45. When the pressure in the hydraulic medium has reached a predetermined pressure, in this case 2500 psi, the sliding door is opened by a ram 46 and the bundle of compressed material is deposited on an output channel 42 under the pressure of the third hydraulic ram 36. The channel has an end section 43 which can be let down or raised up to form a ramp surface along which the bundles ejected from the machine can be slid or pushed as the case may be to a vehicle on which the bundles are to be loaded. The inclination of the ramp surface is controlled by a winch 44. As one bundle enters the channel so the topmost bundle on the channel falls into a container. As soon as a bale has been ejected everything returns to the starting position and the remains of the car fall into the working chamber to enable another twenty four inches to be cut and baled. The bundles produced are in the form of approximately twelve inch cubes.

I claim:

1. A baling machine for baling portions of a large body of metal such as whole car bodies, the machine comprising a working chamber of a size smaller than the body to receive a portion only of the body therein; cutting means for severing the portion of the body received in the working chamber from the remainder of the body, and a ram to compress said portion; said working chamber comprising a portion having lateral walls, in which the ram operates; said cutting means including a fixed blade, and a moving blade carried by said ram for cooperation with said fixed blade to sever off that portion of the body within said chamber from the body of metal on a working stroke of said ram, whereby the body portion is simultaneously compressed and severed; and said ram being mounted to permit a skewing motion thereof and to provide a clearance from the lateral walls of said working chamber to permit said ram to skew during a working stroke thereof, whereby should the moving blade become unevenly loaded due to different toughness of the material of the body being severed, said ram will be caused to skew in said working chamber so as to pivot said moving blade around the tougher material towards said fixed blade and thereby cause said moving blade to exert a greater cutting action.

2. A baling machine according to claim 1, wherein the fixed blade has a "V" section with the apex of the "V" disposed in the direction away from the moving blade.

3. A baling machine according to claim 1, wherein the moving blade is directly supported on a leading edge of the ram.

4. A baling machine according to claim 1, wherein a stop mechanism is provided to determine the compression stroke of the ram; the stop mechanism comprising two stops, one disposed towards each side of the axis of movement of the ram, so that both stops act to stop the ram only when the ram has reached the end of its intended compression stroke and is free from skew.

5. A baling machine according to claim 4, wherein the stop mechanism comprises a pair of rod extending rearwardly from the trailing end of the ram, one disposed towards each side thereof, to pass through respective apertures in abutment surfaces formed on a fixed part of the machine; the rods carrying stops respectively to engage with the abutment surfaces when the ram has reached the end of its intended compression stroke and is free from skew.

6. A baling machine according to claim 4, comprising operating means for the ram controlled by a limit switch, the limit switch being positioned so as to be operated by the ram to terminate the compression stroke of the ram only when the ram is positioned at the end of its intended compression stroke and is free from skew.

7. A baling machine according to claim 1, wherein two further rams are provided to compress the portion of the body in the working chamber; the further rams being arranged so as to compress the portion of the body along axes which are mutually perpendicular and which are perpendicular to the axis of the compression effected by said ram, whereby the portion of the body is compressed into a mass of parallepipedic form.

8. A baling machine according to claim 7, wherein the two further rams operate sequentially following the compression effected by said ram.

9. A baling machine according to claim 7, wherein the working chamber provides an aperture to receive a portion of the body from above the working chamber, and said ram operates to effect compression horizontally.

10. A baling machine according to claim 9, wherein a stop mechanism is provided to determine the compression stroke of said ram; and of the two rams, the ram effecting a vertical compression of the portion of the body, is provided with a stop mechanism substantially identical to the stop mechanism of said ram.

11. A baling machine according to claim 9, wherein the machine comprises a platform to receive the body, means mounting said platform to permit the platform to be swung between a generally horizontal position and a generally vertical position and so positioning said platform that with the body mounted on the platform in the former position, a portion of the body can be deposited in the working chamber through the aperture thereof by swinging the platform to the generally vertical position.

12. A baling machine according to claim 1, wherein the fixed blade delineates the height of the working chamber.

13. A baling machine according to claim 12, wherein the height of said ram is substantially equal to the height of the working chamber.

* * * * *

UNITED STATES PATENT AND TRADEMARK OFFICE

CERTIFICATE OF CORRECTION

PATENT NO. : 4,149,457

DATED : April 17, 1979

INVENTOR(S) : Raymond Barry Smith

It is certified that error appears in the above-identified patent and that said Letters Patent are hereby corrected as shown below:

Claims priority, application Great Britain, November 13, 1976, 47379/76

Signed and Sealed this

*Twenty-fifth* Day of *September 1979*

[SEAL]

*Attest:*

*Attesting Officer*

LUTRELLE F. PARKER

*Acting Commissioner of Patents and Trademarks*